US005600934A

United States Patent [19]

van Rosendal et al.

[11] Patent Number: 5,600,934

[45] Date of Patent: Feb. 11, 1997

[54] DEVICE FOR APPLYING A CLOSING STRIP

[75] Inventors: Nicolaas van Rosendal; Gerardus J. M. Timmermans, both of Hoogeveen, Netherlands

[73] Assignee: Business to Business Innovations B.V., Al Rotterdam, Netherlands

[21] Appl. No.: 446,847

[22] PCT Filed: Dec. 7, 1993

[86] PCT No.: PCT/NL93/00261

§ 371 Date: Jul. 21, 1995

§ 102(e) Date: Jul. 21, 1995

[87] PCT Pub. No.: WO94/13542

PCT Pub. Date: Jun. 23, 1994

[30] Foreign Application Priority Data

Dec. 7, 1992 [NL] Netherlands ..... 9202118

[51] Int. Cl.[6] ..... B65B 51/04

[52] U.S. Cl. ..... 53/139.1; 53/389.3; 53/583

[58] Field of Search ..... 53/583, 139.1, 53/417, 419, 137.2, 389.2, 389.3

[56] References Cited

U.S. PATENT DOCUMENTS

| | | | |
|---|---|---|---|
| 3,729,896 | 5/1973 | Lehmann | 53/583 |
| 4,648,531 | 3/1987 | Won | 53/417 |
| 4,718,220 | 1/1988 | van Rosendai et al. | 53/583 |
| 4,721,545 | 1/1988 | Santorineos | 53/583 |

FOREIGN PATENT DOCUMENTS

| | | | |
|---|---|---|---|
| WO85/01266 | 3/1985 | WIPO | 53/583 |
| WO91/02682 | 3/1991 | WIPO | 53/139.1 |

*Primary Examiner*—John Sipos
*Assistant Examiner*—John Paradiso
*Attorney, Agent, or Firm*—Larson and Taylor

[57] ABSTRACT

A device for applying a closing strip, which device comprises for this purpose a box-like housing profiled with a channel (6). The housing herein comprises a first storage space for adhesive tape, first through-feed means for feeding a strip of adhesive tape from said space to the channel, and a rotor with fins for guiding the adhesive tape into the channel with the sticking side facing outward. The housing further comprises a second storage space for tape-like material, second through-feed means for feeding a strip of tape-like material from the second drum-shaped space to the channel. Means are present in the channel for forming a closing strip tape from the supplied strip of adhesive tape and the tape-like material, in addition to cutting means for severing the closing strip. The second drum-shaped space is partially enclosed by removably embodied closing means (35).

6 Claims, 8 Drawing Sheets

DEVICE FOR APPLYING A CLOSING STRIP

The invention relates to a device for applying a closing strip, which device comprises for this purpose a box-like housing profiled with a channel, wherein a first part of the housing bounded by the channel is provided with a first drum-shaped space for storing adhesive tape, with first through-feed means for feeding a strip of adhesive tape from the drum-shaped space to the channel, and with a rotor having fins protruding into the channel for further guiding said strip of adhesive tape into the channel with the sticking side facing outward;

wherein a second part of the housing bounded by the channel is provided with a second drum-shaped space for storing tape-like material, with second through-feed means for feeding a strip of tape-like material from the second drum-shaped space to the channel, wherein on the outlet side of the through-feed means associated with the tape-like material further means are present for forming a tape piece in said closing strip during guiding thereover of the strip of adhesive tape guided via the rotor into the channel and the supplied strip of tape-like material, and wherein at the end of said channel cutting means are present for severing the formed closing strip from the closing strip tape.

Such a device is known from WO-A-88/08395. The device shown in this publication for applying a closing strip is provided with a cassette with a paper tape which is pushed into a suitable cavity in the side of the device. The drawback to the use of such a device with cassette lies in the costs associated with the use of such a cassette, in which are further arranged specially designed through-feed means with strip-like element to prevent undesired return of the paper tape to the cassette. After the paper roll has been used up, such a cassette does not allow of easy filling with paper tape by the user for re-use.

The invention has for its object to obviate this drawback. According to the invention the edge side, located on the access side of the channel, of the second part of the housing bounded by the channel is at least partially formed by removably embodied closing means which closes the second drum-shaped space and which in the closing position co-acts form-fittingly with a bridge piece situated in the second drum-shaped space in order to obtain said second through-feed means for placing in a clamping position a strip of tape-like material present at that position.

The invention will now be further elucidated with reference to the accompanying figures, wherein.

Figure 1:
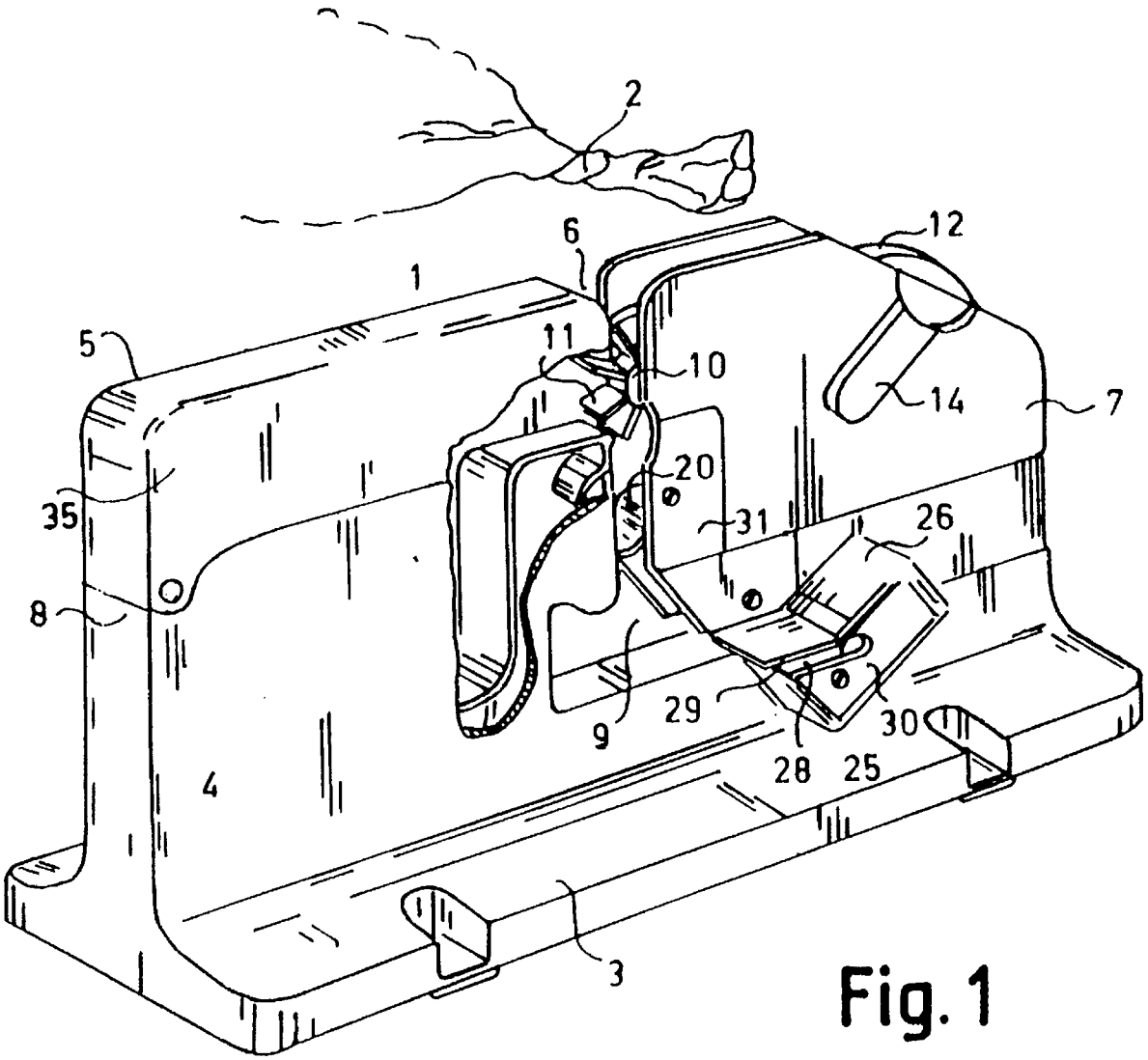
FIG. 1 shows a perspective view of a first embodiment of the device for applying a closing strip.

Shown in FIG. 1 is a possible embodiment of a device for applying a closing strip round an enclosure 2 such as a twisted together end of a plastic bag. For the sake of simplicity the device can be divided into a housing 1 in box-like form with means for applying the closing strip, and a base plate 3 positioned perpendicularly of this housing 1. Housing 1 comprises two side surfaces 4 and 5 and is further provided with a channel 6, which roughly divides each of the side surfaces 4 and 5 into two equal box portions 7 and 8 and which forms the path of movement for the enclosure 2 to be girded with a closing strip.

In preference the channel 6 is embodied over practically the whole length as a straight gap, which implies the advantage of an easier running guiding for enclosure 2.

The manner in which the closing strip is applied round the enclosure 2 will now be explained, also with reference to FIG. 2, wherein this figure shows a partly cut away and broken away front view of the device shown in FIG. 1.

When the twisted together portion of enclosure 2 is carried through the channel 6 in the direction of the closed end 9, it passes first over a rotor 10 which is arranged to the side of channel 2 in the box portion 7, and which is provided with radially oriented blades or spokes 11 protruding far into the channel 6.

These blades 11 guide a strip of one-sided adhesive tape 12 supplied from the box portion 7 via guide means to the channel 6, wherein the adhesive tape will adhere to a large portion of the surface of the enclosure 2. The channel 6 embodied substantially as straight gap has the result that, when the enclosure 2 is introduced into channel 6, the enclosure 2 is carried deeply into the opening between two successive blades, whereby enclosure 2 is covered with the adhesive tape 12 over a large part of the periphery. The blades 11 are herein dimensioned such that it is impossible for the enclosure 2 to be carried downward past the outside of the blades 11, whereby insufficient adhesive tape would be able to engage onto enclosure 2. The strip of adhesive tape 12 comes from a roll or a reel 13 situated in a hollow space 16 of box portion 7. When the roll or reel 13 can rotate on a hub or shaft 15, channel-like guide means 14 are arranged for this purpose in box portion 7.

On the sides of the reel 13 a rubber ring can also be arranged round the shaft 15 with which reel 13 makes frictional contact with the channel-like guide means 14 and whereby free turning and thereby undesired unwinding of adhesive tape 12 from the roll or reel 13 is avoided.

Herein the rotor 10 can further be advantageously provided with clamping means (not shown in the figure) such as a clamping spring arranged over the rotor shaft, whereby rotor 10 is not permitted any free rotational movement. This prevents an unnecessarily large amount of adhesive tape 12 being unwound from reel 13 during applying of a closing strip. When enclosure 2 is pressed further into channel 6, another strip of tape-like material, such as paper tape 17, is added in the channel 6 beyond the rotor 10 to the enclosure 2 with the strip of adhesive tape 12, which material will adhere to that portion of the supplied strip of adhesive tape which has not adhered to enclosure 2. The strip of paper tape 17 is supplied from another reel or roll 18 which is stored in a drum-shaped space 34 present in the other box portion 8. In order to enable securing of the reel 18 or roll with paper tape 17 in the drum-shaped space 34, the peripheral surface of box portion 8 connecting onto the access side of channel 6 is embodied closably using a folding or closing cover 35 acting as closing means. The point of rotation of folding cover 35 may be located in this part of the peripheral surface of box portion 8 as well as in the adjoining side face.

Feed of paper tape 17 from the space 34 to the channel 6 takes place via through-feed means 19. When the enclosure 2 with adhesive and paper tape 12 and 17 is carried deeper into the channel 6, these elements there pass over cutting means 20 which are fixed to the housing 1 and active in the channel 6 and with which the adhesive tape 12 with the paper tape 17 adhered thereto is severed, and the applying of a closing strip of adhesive tape and paper tape round the enclosure therefore completed. These cutting means 20 comprise in this embodiment a member 21 embodied as a knee lever which is arranged for rotation on the angle point thereof in box portion 7, this such that in the rest position of this member 21 an arm part 22 thereof is positioned in the path of movement of the enclosure 2 in channel 6.

The other arm part 23 of knee lever 21 is provided with a cutting member 24.

When enclosure 2 presses down the arm part 22 located in said path of movement, the member 21 will begin to turn on its point of rotation. The other arm part 23 with the cutting member 24 will hereby begin to turn in the direction of the closing strip tape, which will result in the closing strip tape being severed by cutting member 24. Finally, at the closed end 9 of the channel 6 is situated another cutting device 25 with which the excess portion of enclosure 2 beyond the closing strip can be cut to size. Cutting device 25 comprises for this purpose a knife blade 27 received in a chamber 26. Connecting onto chamber 26 as finger protection 28 is a standing edge 29 of a cover 30. The knife blade 27 is thus inaccessible for fingers (particularly important with respect to children), while the enclosure 2 can still reach the knife blade 27 for performing of the cutting operation.

Chamber 26 is accessible via cover 30 which is fastened thereon using screws. The cutting means 20 are also accessible via a detachable cover 31 for replacement or servicing.

A further description of the device described with reference to FIGS. 1 and 2 will now be given with additional reference to FIGS. 3 and 4.

These figures show that the device is provided with a forward protruding edge 32 lying transversely of the channel 6 which ensures that at the position of this edge a fold is made in the tape of adhesive and paper strip, whereby enclosure 2 and the free portions of the adhesive tape 12 on the one side and the paper tape 17 on the other side are pressed properly against each other, whereby the closing strip of adhesive and paper tape to be formed therein will tightly embrace the enclosure 2. At this edge 32 the substantially straight channel 6 is curved sidewards.

Figure 2:
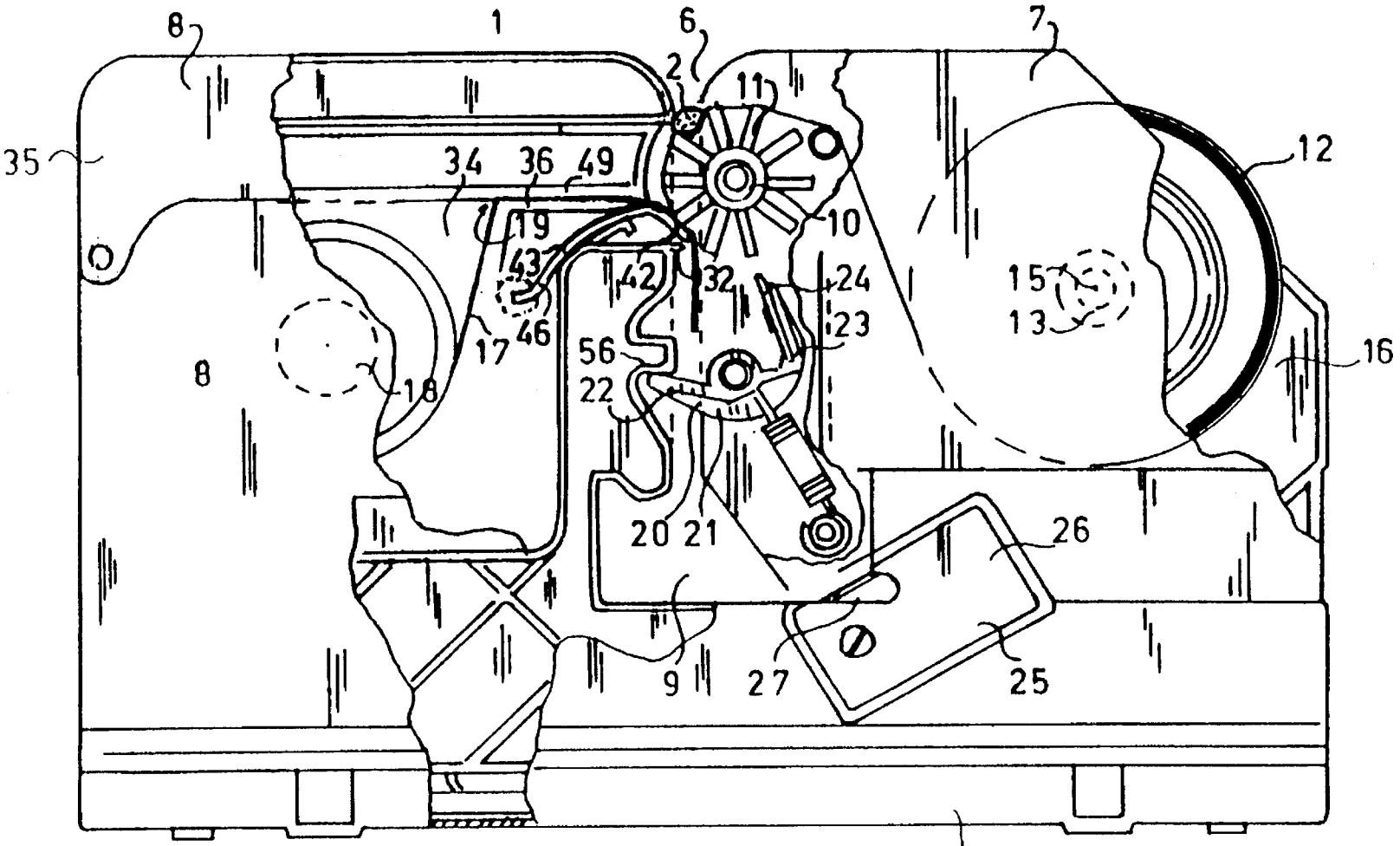
FIG. 2 shows a partly cut away and broken away front view of the device shown in FIG. 1.
Figure 3:
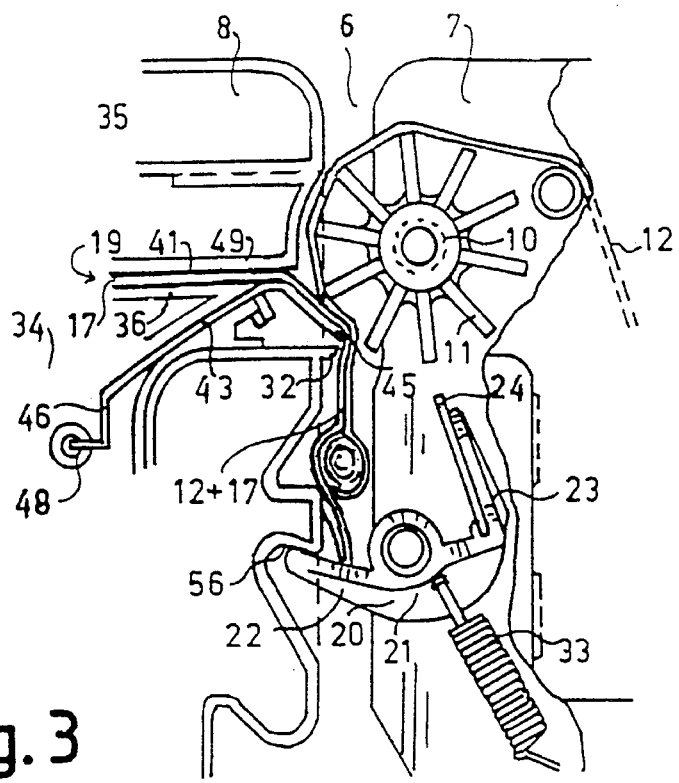
FIGS. 3 and 4 show two different positions of use of the device depicted in FIG. 2 during applying of a closing strip.
Figure 4:
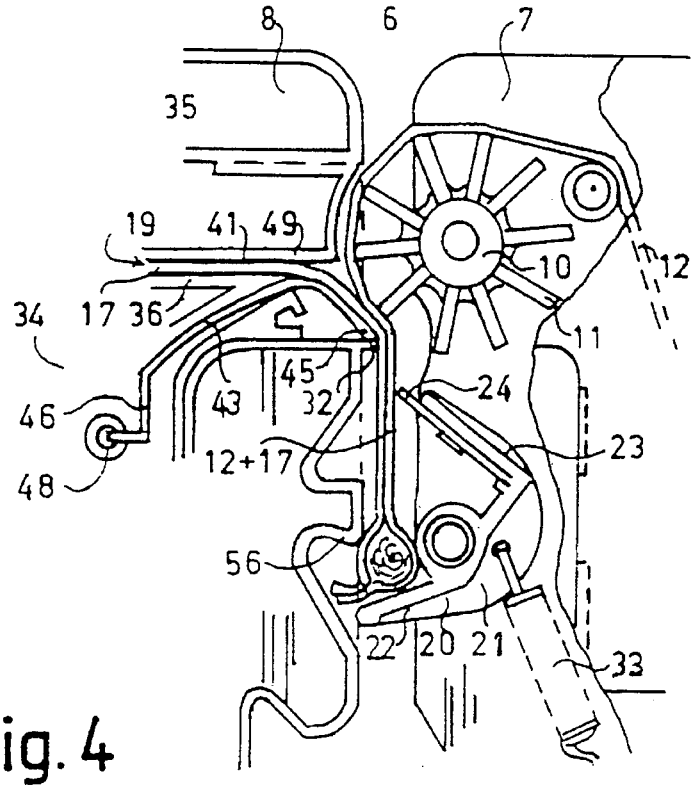

In FIG. 3 the enclosure 2 with the closing strip of adhesive tape 12 and paper tape 17 arranged therearound has already passed over the edge 32. FIG. 4 further shows clearly that when the cutting means 20 are actuated the mutually adhered strips 12 and 17 are stretched tightly. This provides a good cutting effect of knife blade 27 entailing only a small actuation of these cutting means 20, whereby a sharp line of cut will be formed. After the closing strip has passed over arm part 22 and thus been severed, the cutting means 20 return once again under influence of a spring mechanism 33 to the rest position shown in FIG. 2. The arm part 22 hereby comes to rest again against a stop 56 formed on box portion 8 and protruding into channel 6.

Figure 5:
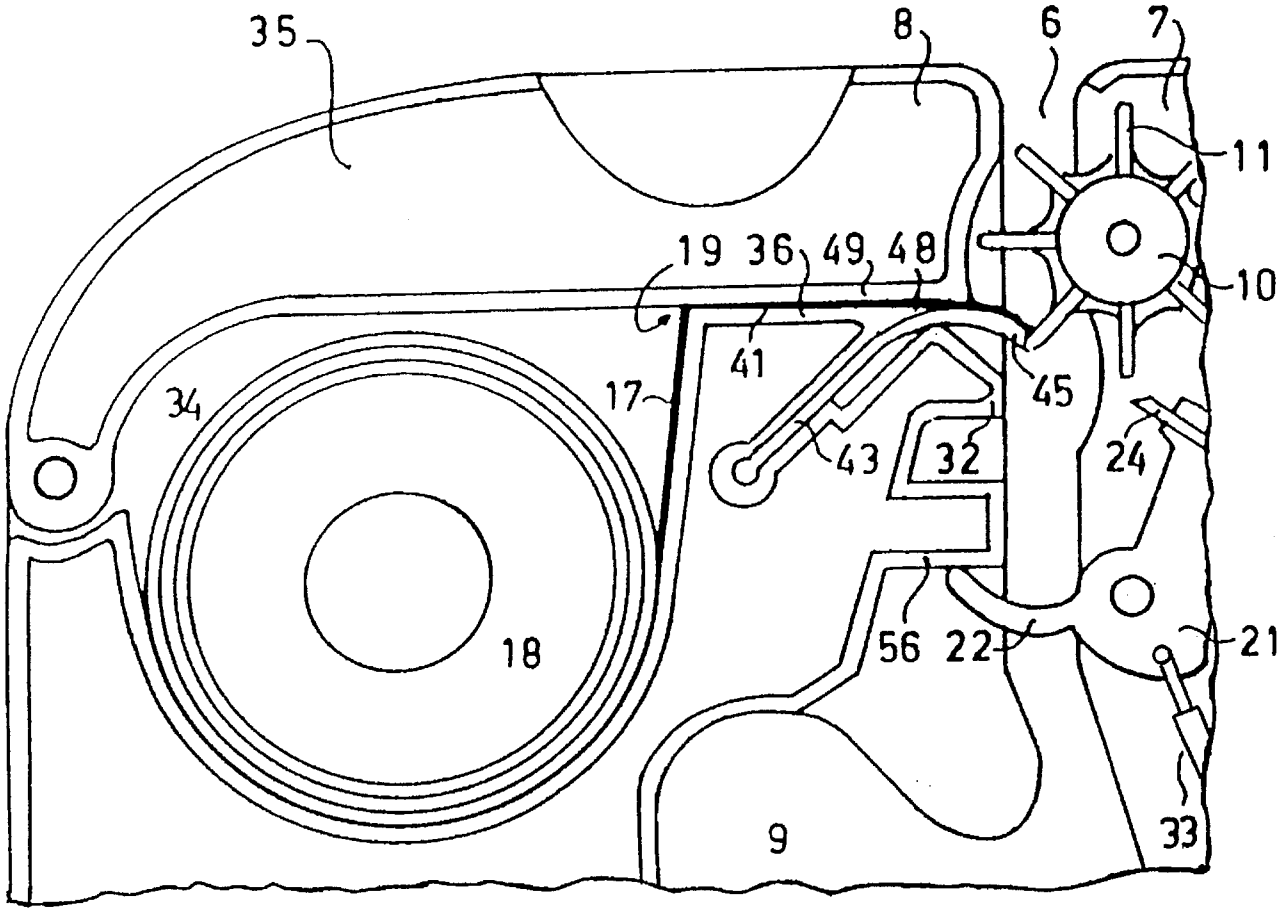
FIGS. 5 and 6 show a section of a part of the device for applying a closing strip, wherein the closing means are respectively situated in folded-down position and pivoted outward through a certain angle.

As shown in FIG. 5, the feed of a strip of paper tape 17 along the through-feed means 19 takes place via a passage 41 located between the cavity 8 and the channel 6. This passage 41 is wholly closed off at the sides by the side surfaces 4 and 5, which prevents undesired shifting of paper tape 17 in sideways direction. Passage 41 must have the narrowest possible through-feed opening for paper tape 17, as otherwise when the enclosure 2 is fed through the channel 6 at great speed the reel 13 with adhesive tape 12 will, as a result of the therein occurring jerking movements, continue to rotate through a certain angle, whereby the unwound strip of adhesive tape 12 is pulled back again to the reel 13. This also results in a long strip of paper tape 17 also being pulled back along the blades 11 to the reel 13. The jerking movements on the paper tape 17 occurring during such use of the device will also result in a free rotation of the roll or reel 18 with paper tape 17, whereby paper tape 17 will be unwound from the reel 18 or from the roll over a great length and will then accumulate it the front of passage 41. When the paper tape 17 and the adhesive tape 12 herein also become detached from one another due to the still weak adhesion, this will result in the paper tape 17 again being pulled back over a certain length toward the reel or roll 18.

In order to prevent the adhesive tape 12 and paper tape 17 being pulled back toward the respective rolls or reels 13 by jerking movements as stated in the foregoing, the box part 8 is provided with blocking means 42 which protrude into channel 6 and which co-act with blades 11 as a ratchet mechanism in order to prevent the return rotation movement of rotor 10. Thus, when rotor 10 begins to rotate back, a piece of tape of the tape-like material 17 and the adhesive tape 12 will be clamped between the means 42 and the thereby blocked blade 11, whereby the stated objective is achieved. A possible embodiment of said blocking means 42 is obtained by embodying these means as a strip-like element 43 and manufacturing them from resilient material, wherein this element takes the form of an arcuate profile at the end 39 protruding into the channel 6. This outer end has to co-act with the blades 11 of rotor 10, this such that rotor 10 is on the one hand not impeded in its rotation movement during feed of an enclosure 2 through channel 6 but is on the other hand blocked when rotor 10 wants to begin a return rotation movement.

The other end 46 of strip-like element 43 is anchored in a groove-like clamping point 48.

The folding cover 35, as seen in the plane of movement thereof, widens on the side of the channel 6 and forms with the underside running out towards the channel 6 the upper wall 49 of the passage 41. The bottom wall 36 of passage 41 is a fixed bridge piece between both side surfaces 4 and 5 and co-acts form-fittingly with the upper wall 49 forming part of the folding cover 35 when the folding cover is in the folded down position, as shown in this figure. When paper tape 17 is carried from the reel or roll 18 via passage 41 to the channel 6, when folding cover 35 is in folded down position, due to the own weight thereof a clamping action of the folding cover will be produced on the paper tape 17.

Only when a blade 11 pulls downward the combination of adhesive tape 12 and paper strip 17 will the paper strip 17 be allowed through over a certain length. This prevents forces occurring in shock-wise manner being able to transmit themselves to the roll or reel 18 with tape-like material 17 present in the drum-shaped space 34, therein causing the material to unroll from the reel over a great length.

As soon as enclosure 2 has passed over edge 32, and the closing strip is subsequently cut to length, the paper strip 17 is held clampingly in place in the passage 41.

Figure 6:
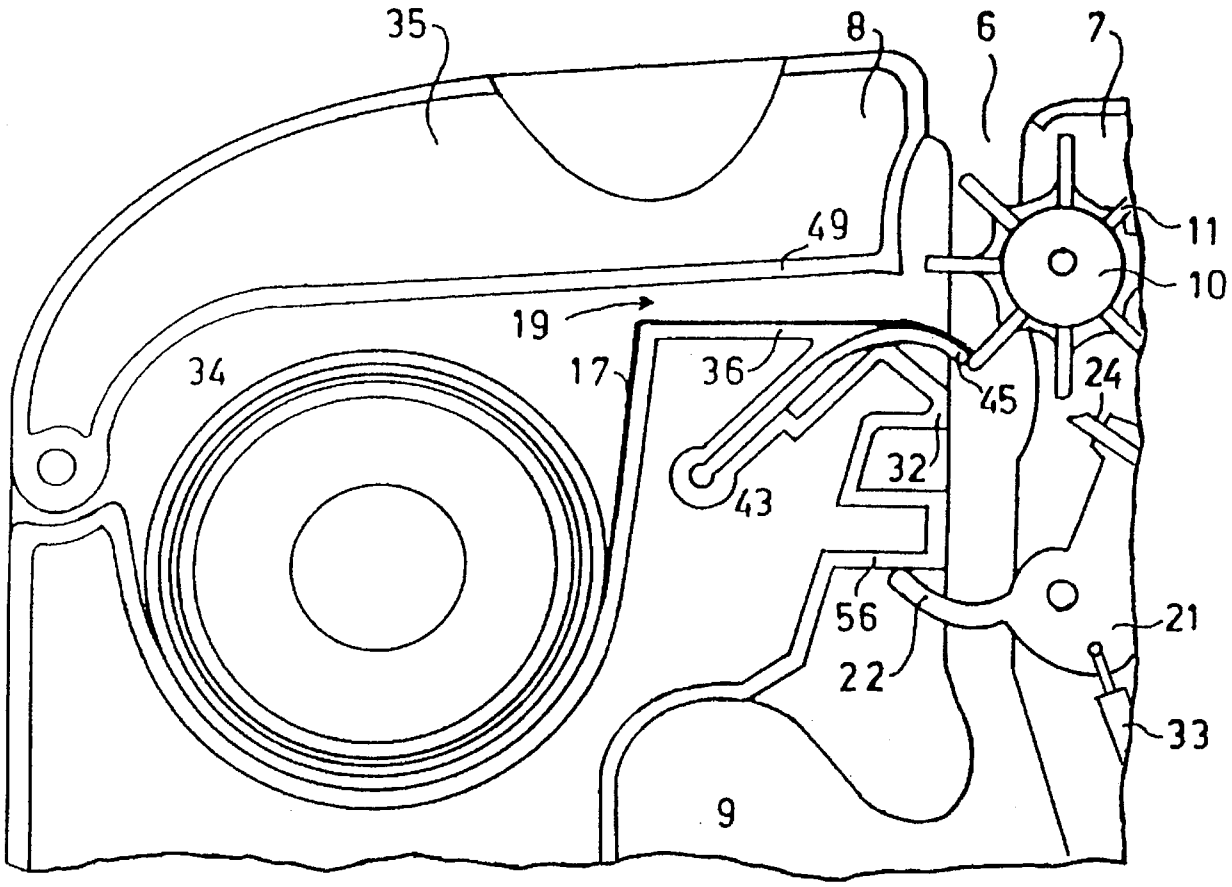

The part of the device for forming a closing strip shown in FIG. 6 is identical to that in FIG. 5, wherein however in FIG. 6 the folding cover 35 is pivoted upward through a certain angle.

Figure 7:
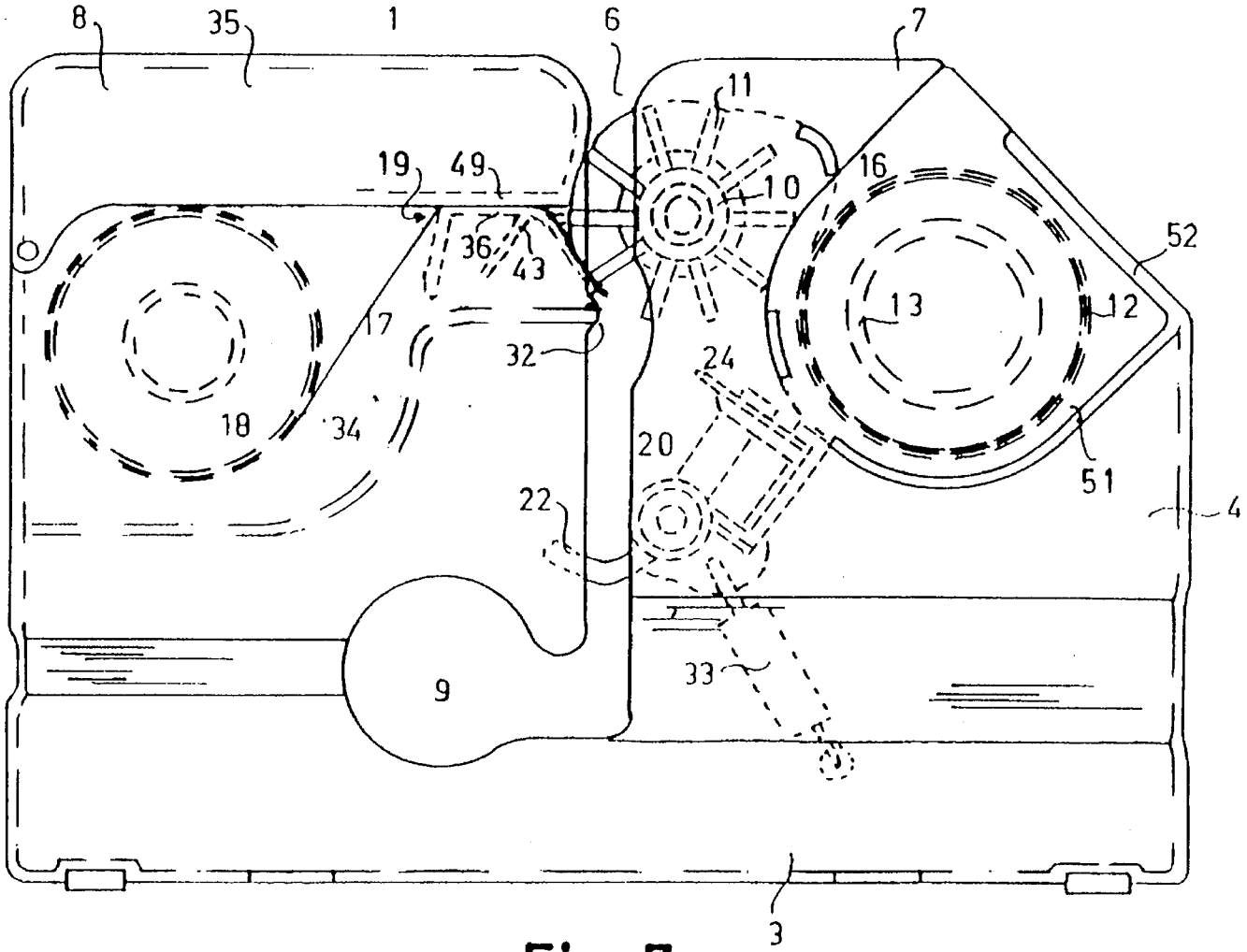
FIG. 7 shows a second embodiment of the device for applying a closing strip.

A very practical embodiment of a device for applying a closing strip for domestic use is depicted in FIG. 7.

The parts appearing in this embodiment which have in common with parts of the embodiment shown in FIG. 2 that they have a corresponding application are designated with the same reference numerals and will not be discussed here once again.

In the embodiment of the device depicted in this figure the reel or roll 13 with adhesive tape 12 is received in a different manner in the device. In the embodiment shown here a slide-away protective cover 51 is arranged for this purpose in side surface 4 of box unit 7. When protective cover 51 is removed the reel 13 with adhesive tape 12 can be placed in position and the adhesive tape 12 guided toward the blades 11. The protective cover 51 can then be re-arranged in its position. Although protective cover 51 can be pressed from the side onto side surface 4, recommended in this embodiment is a protective cover 51 embodied as a slide cover for sliding of the protective cover into the opening. The slide profile parts in protective cover 51 and the side surface 4 herein co-act form-fittingly.

The protective cover 51 further has a strip 52 standing at right angles to the slide cover, which prevents the reel 13 from being able to come out of the box unit 7. This embodiment likewise has several passage openings in base plate 3 of the device enabling a screw fastening of the device on the wall.

Figure 8:
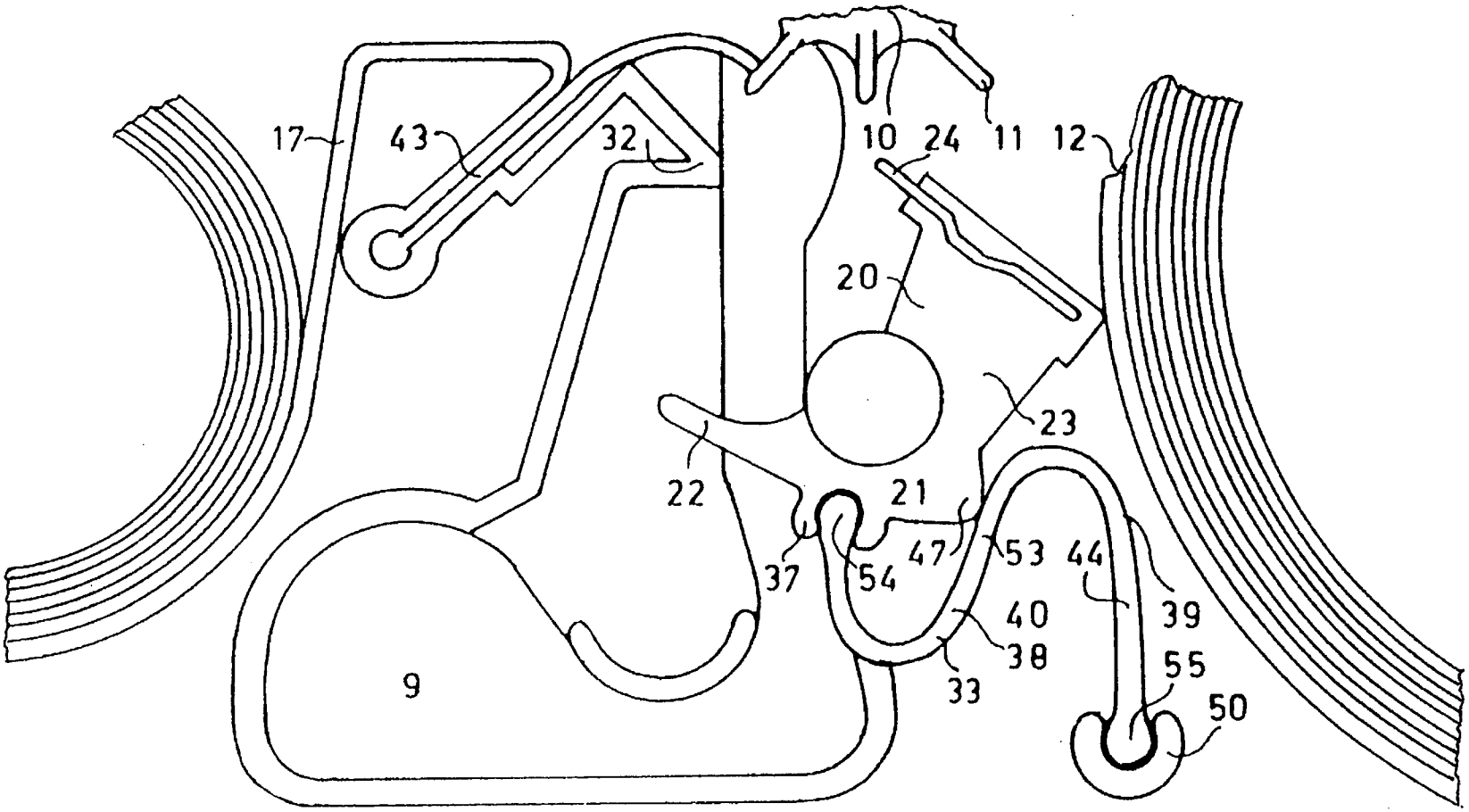
FIG. 8 shows a possible embodiment of an element of the device for applying a closing strip.

An enhanced embodiment of the cutting means 20 with spring mechanism 33 is shown in FIG. 8.

In this figure the member 21 embodied as knee lever and rotatable on an angle point is provided successively on the outer peripheral surface, running from the arm part 22 protruding into the channel 6 in the direction of cutting member 24, with bifurcated locking means 37 and with a bend 47 profiled as a bulge. The fixing position of the spring mechanism 33 fixedly situated in housing 1 is also embodied here as bifurcated locking means 50.

In addition the spring mechanism embodied as a spiral spring is replaced by a spring mechanism 40 manufactured from plastic. The spring mechanism made of plastic is embodied here as a plastic spring strip 44 with two bends 38 and 39 running in opposing directions, wherein the transition part 53 of both bends 38 and 39 lies against the bend part 47 of member 21 with the bulge profile. The extremities 54 and 55 of spring strip 44 take a thickened form and are received therewith in the associated locking means 37 and 50.

When an enclosure 2 presses against arm part 22 and therein causes the member 21 to rotate, both bends 38 and 39 will be pressed together and come under spring tension. As soon as enclosure 2 has passed beyond cutting means 20, the spring strip 44 under spring tension will cause the spring mechanism 40 to move back again.

Both bends 38 and 39 are preferably of equal size so as to be able to absorb the spring tension in equal measure.

It is also possible to embody the closing cover 35 acting as closing means not as a folding cover but as slide cover. This latter can then be pushed sideways away from the channel 6, wherein the drum-shaped space 34 becomes freely accessible. Slide profile parts in slide cover 35 and box part 8 herein co-act form-fittingly.

In dusty areas, which can for instance include company warehouse and dispatch departments and workshops, it is desirable to keep the roll of adhesive tape 12 as well as the space 16 in which this roll is situated as dust-free as possible.

It is also desirable, as the situation occurs, such as when a roll 12 is exchanged, to have access to the space for the roll as quickly as possible.

Figure 9:
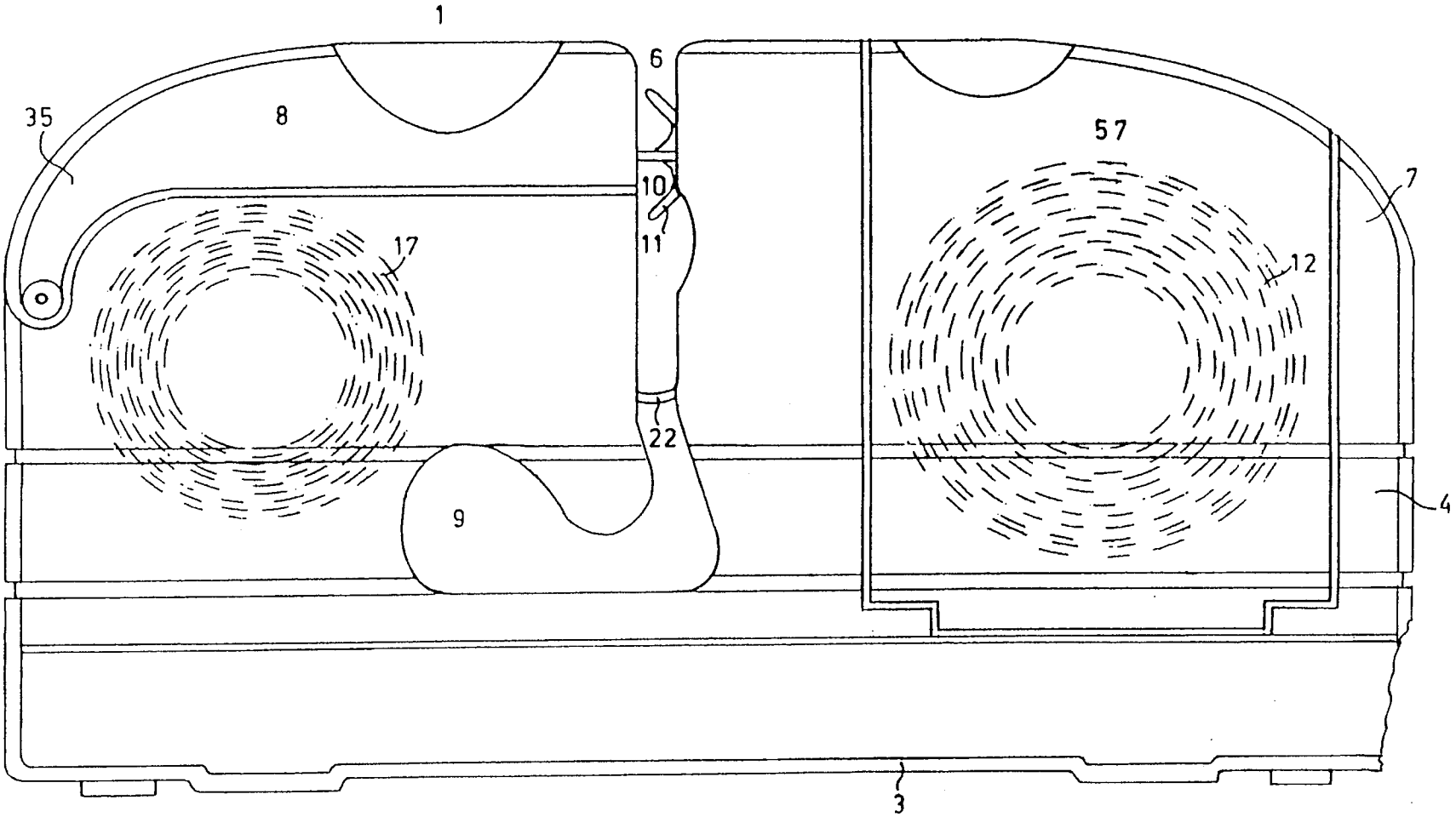
FIG. 9 shows a portion of a subsequent possible embodiment of a device for applying a closing strip.

Shown in FIG. 9 is an embodiment of a device for applying a closing strip which satisfies the above stated requirements.

This device is provided in the side surface 4 at the position of the roll 12 with a cover plate or plate cover 57 embodied for sliding out in upward direction.

When the cover plate 57 is removed from side surface 4 a new roll 12 can be inserted in the opened space 16, wherein the starting piece of the adhesive tape 13 is guided to the rotor 10 in channel opening 6. The cover plate 57 is then put back in place.

In a possible embodiment of cover plate 57 this is also provided with a suitable portion of the peripheral edge surface (upper edge), which is then fixed at right angles to the surface part of cover plate 57 fitting into the side surface 4. Cover plate 57 can for instance be embodied with a form-fittingly embodied slide-in mechanism and/or be arranged in position with a snap connection. In the case the slide-in mechanism is used the slide profile parts in cover plate 57 and the side surface 4 co-act form-fittingly.

It is also possible to embody the cover plate as an element which can be moved aside on a pivot shaft.

We claim:

1. A device for applying a closing strip around an enclosure such as a plastic bag, comprising:

a box-like housing having two side surfaces and a peripheral surface, a channel through which the enclosure is moved during application of the closing strip, said channel having an access side near the peripheral surface of the housing and a closed end, said channel dividing the housing in a first part and a second part, and cutting means located at the closed end of the channel for severing the closing strip applied around the enclosure from a remainder of said closing strip, wherein said first part of the housing is provided (a) with a first drum-shaped space for storing adhesive tape on a reel and having an adhesive face, (b) with first through-feed means for feeding a strip of adhesive tape from said first drum-shaped space to the channel, and (c) with a rotor having fins protruding into the channel for further guiding said strip of adhesive tape into the channel with the adhesive face facing outward, wherein said second part of the housing is provided (a) with a second drum-shaped space for storing a tape-like material on a reel, and (b) with a passage having an upper and a bottom wall, said passage connecting said second drum-shaped space to said channel for feeding a strip of the tape-like material from the second drum-shaped space to the channel, wherein on an outlet side of said passage, there is a means for adhering the strip of tape-like material to a portion of the adhesive tape strip which has not adhered to the enclosure during the guiding thereover of the enclosure, wherein, for securing said tape-like material in the second drum-shaped space, the second part of the housing, near the access side of the channel includes a cover movably attached over the second drum-shaped space, said cover closing the second drum-shaped space and also forming the upper wall of said passage connecting the second drum-shaped space to the channel, the bottom wall of said passage being a bridge piece fixed between the two side surfaces of the housing in the second part, and wherein said upper wall and said bottom wall of the passage co-act form-fittingly when said cover is in the position closing the second drum-shaped space, and produce a clamping action on the strip of tape-like material present therebetween in said passage.

2. A device as claimed in claim 1, wherein the cover is embodied as a folding cover foldable downward on a point of rotation.

3. A device as claimed in claim 1, wherein the cover takes the form of a slidably embodied protective cover.

4. A device as claimed in claim 1, wherein the access side of said housing closing off the first drum-shaped space is provided with removably embodied closing means closing off this space.

5. A device as claimed in claim 4, wherein the closing means associated with the first drum-shaped space take the form of a slidably embodied protective cover.

6. A device as claimed in claim 4, wherein the closing means associated with the first drum-shaped space take the form of a folding cover embodied for rotation on a rotating shaft.

* * * * *